US010302384B1

(12) United States Patent
Lee

(10) Patent No.: US 10,302,384 B1
(45) Date of Patent: May 28, 2019

(54) FIREARM BARREL FITMENT SLEEVE AND METHOD OF USE

(71) Applicant: Darryl S. Lee, Fort Myers, FL (US)

(72) Inventor: Darryl S. Lee, Fort Myers, FL (US)

(73) Assignee: DBDROP Inc., Fort Myers, FL (US)

( * ) Notice: Subject to any disclaimer, the term of this patent is extended or adjusted under 35 U.S.C. 154(b) by 0 days.

(21) Appl. No.: 15/625,542

(22) Filed: Jun. 16, 2017

Related U.S. Application Data

(63) Continuation of application No. 15/499,430, filed on Apr. 27, 2017, now Pat. No. 10,066,890, and a continuation of application No. 15/601,528, filed on May 22, 2017, now Pat. No. 9,891,017.

(51) Int. Cl.
*F41A 21/32* (2006.01)
*F41A 21/44* (2006.01)

(52) U.S. Cl.
CPC ..... *F41A 21/325* (2013.01); *F41A 21/44* (2013.01)

(58) Field of Classification Search
CPC ..... F41A 21/10; F41A 21/00; F41A 21/30; F41A 21/32; F41A 21/325; F41A 21/04; F41A 21/44
See application file for complete search history.

(56) References Cited

U.S. PATENT DOCUMENTS 1,538,243 A * 5/1925 Gorton ..... F41A 21/34 89/14.2
2,339,777 A * 1/1944 Green ..... F41A 21/34 89/14.5
2,351,037 A 6/1944 Green
2,866,288 A 12/1958 Herter
3,710,679 A 1/1973 Werbell, III
3,776,093 A * 12/1973 Leverance ..... F41A 21/30 89/14.2
4,341,283 A * 7/1982 Mazzanti ..... F01N 1/06 181/223
4,346,643 A * 8/1982 Taylor ..... F41A 21/44 89/14.1
4,424,734 A * 1/1984 Janssen ..... F41A 21/44 89/16
4,638,713 A * 1/1987 Milne ..... F41A 21/44 89/14.1
4,663,875 A * 5/1987 Tatro ..... F41C 23/16 165/134.1

(Continued)

FOREIGN PATENT DOCUMENTS

GB 264448 A * 2/1927 ..... F41A 21/04
GB 2350881 A * 12/2000 ..... F41A 21/28

*Primary Examiner* — Benjamin P Lee
(74) *Attorney, Agent, or Firm* — Nicholas Pfeifer Smith & Hopen, P. A.

(57) ABSTRACT

A firearm barrel fitment sleeve and method of use. The fitment sleeve is preferably fast-attaching, self-aligning, and securable without the need of a tool. The novel fitment sleeve allows a single firearm accessory adapter to be used with a wide range of firearm barrels by temporarily modifying the size of the barrel diameter without permanently modifying the structure of the firearm. The fitment sleeve is inexpensive and preferably includes a longitudinally extending slot in the lateral wall making a single fitment sleeve usable on a wide variety of barrel diameters. Additionally, the fitment sleeve is heat resistant to avoid melting and/or catching fire when the barrel increases in heat during operation.

16 Claims, 18 Drawing Sheets

(56) References Cited

U.S. PATENT DOCUMENTS

| | | | | | |
|---|---|---|---|---|---|
| 4,841,836 | A * | 6/1989 | Bundy | F41A 21/44 | 89/14.1 |
| 5,400,691 | A * | 3/1995 | Suttie | F41A 21/44 | 89/14.1 |
| 5,753,846 | A * | 5/1998 | Koon | F41A 21/28 | 42/75.02 |
| 6,508,159 | B1 * | 1/2003 | Muirhead | F41A 21/24 | 42/76.01 |
| 6,885,332 | B2 * | 4/2005 | Panek | F41A 13/12 | 342/1 |
| 9,103,618 | B2 * | 8/2015 | Daniel | F41A 21/325 | |
| 9,239,202 | B2 * | 1/2016 | Michal | F41A 21/24 | |
| 9,528,785 | B2 * | 12/2016 | Klett | F41A 21/44 | |
| 9,658,010 | B1 * | 5/2017 | Oglesby | F41A 13/12 | |
| 2004/0119629 | A1 * | 6/2004 | Hinsverk | F41A 13/12 | 342/3 |
| 2012/0167435 | A1 * | 7/2012 | Poling | F41A 13/12 | 42/90 |
| 2012/0227302 | A1 * | 9/2012 | Fonte | F41A 21/02 | 42/78 |
| 2014/0059913 | A1 * | 3/2014 | Diamond | F41C 27/00 | 42/90 |
| 2014/0216237 | A1 * | 8/2014 | Butler | F41A 21/36 | 89/14.4 |
| 2015/0001002 | A1 * | 1/2015 | Wirth | F41A 21/30 | 181/223 |
| 2015/0241159 | A1 * | 8/2015 | Michal | F41A 21/30 | 89/14.4 |
| 2015/0316342 | A1 * | 11/2015 | Hart | F41A 21/02 | 42/76.01 |
| 2017/0191780 | A1 * | 7/2017 | Barrett | F41A 21/30 | |

* cited by examiner

FIREARM BARREL FITMENT SLEEVE AND METHOD OF USE

CROSS-REFERENCE TO RELATED APPLICATIONS

This nonprovisional application is a continuation of and claims priority to nonprovisional application Ser. No. 15/499,430, entitled "FIREARM SUPPRESSOR ADAPTER," filed Apr. 27, 2017 by the same inventor, and is also a continuation of and claims priority to nonprovisional application Ser. No. 15/601,528, entitled "FIREARM SUPPRESSOR ADAPTER," filed May 22, 2017 by the same inventor.

BACKGROUND OF THE INVENTION

1. Field of the Invention

This invention relates, generally, to firearms accessories. More specifically, it relates to a universal fitment sleeve and method of use for firearm barrels and adapters.

2. Brief Description of the Prior Art

Most gunfire produces sound that exceeds 140 dB, which can cause immediate and irreparable hearing loss to the gun operator and also significantly contributes to sound pollution. The effects of gun-fire noise are evidenced by the prevalence of hearing damage among veterans, law enforcement, and older individuals that have been around unsuppressed gunfire. Fortunately, firearm suppressors or "silencers" can reduce the gun-fire noise to a safe hearing range below 140 dB.

Despite the obvious health and societal benefits of suppressor use, suppressors are uncommon because most do not easily fit more than one firearm and are generally inflexible, narrowly sized, and likely to damage a firearm barrel. There are a few methods for attaching a suppressor to a non-threaded barrel of a firearm. Most, however, are inflexible and only work with a very narrow range of firearms with a similar barrel diameter, barrel geometry, and location of barrel protrusions.

Accordingly, what is a device that will allow a single adapter to easily fit a wide variety of firearm barrels. However, in view of the art considered as a whole at the time the present invention was made, it was not obvious to those of ordinary skill in the field of this invention how the shortcomings of the prior art could be overcome.

While certain aspects of conventional technologies have been discussed to facilitate disclosure of the invention, Applicant in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a device that will allow a single adapter to easily fit a wide variety of firearm barrels is now met by a new, useful, and nonobvious invention.

The novel invention includes a firearm barrel fitment sleeve having a first end and a second end, with a length extending therebetween. A barrel-receiving bore extends the length of the fitment sleeve and establishes a generally tubular, lateral wall having an internal surface and an external surface. An embodiment includes a slot in the lateral wall that extends the full length of the fitment sleeve, thereby creating a discontinuous circumference. The slot creates a circumferential-gap, which is preferably less than a circumferential length of the fitment sleeve.

The fitment sleeve further includes the internal surface being heat-resistant to temperatures in excess of 150 degrees Fahrenheit. An embodiment includes the internal surface being heat-resistant to temperatures in excess of 1300 degrees Fahrenheit.

The fitment sleeve is preferably made of a flexible material, thereby allowing the fitment sleeve to flex around a firearm barrel having a diameter greater than a diameter of the internal surface of the fitment sleeve when the fitment sleeve is in a position of repose. Moreover, the fitment sleeve is also preferably made of a compressible material, thereby allowing an adapter secured around the fitment sleeve to compress the fitment sleeve towards a barrel of a firearm.

In an embodiment, the fitment sleeve has an inner surface having a tapered design, such that the thickness of the fitment sleeve is greater proximate a first end than a second end. Such a design compensates for firearm barrels having a tapered design.

An embodiment may include an outwardly-extending annular flange proximate the first end of the fitment sleeve with the slot extending through the annular flange, such that the annular flange has a discontinuous circumference. Alternatively, or in addition to, the fitment sleeve may have an annular flange proximate the second end of the fitment sleeve with the slot extending through the annular flange, such that the annular flange has a discontinuous circumference. In an embodiment, the annular flange proximate the first end of the fitment sleeve extends inwardly and is sloped or curved such that an axial force causing the barrel of the firearm to contact the sloped annular flange will funnel the firearm barrel into axial alignment with the barrel-receiving bore.

The fitment sleeve may also include a plurality of friction-enhancing structural members disposed on an internal surface of the fitment sleeve, including but not limited to grooves, ridges, and slots.

The novel method of attaching a firearm accessory adapter to a barrel of a firearm includes securing the firearm fitment sleeve to a section of the barrel of the firearm and then securing the firearm accessory adapter to the firearm in overlying relation to the fitment sleeve.

An embodiment includes the additional steps of determining an outer diameter of the barrel of the firearm, determining a range for a maximum inner diameter of the firearm accessory adapter and a minimum inner diameter of the firearm accessory adapter, and selecting a particular firearm fitment sleeve based on a thickness of the lateral wall of the firearm fitment sleeve, such that the sum of the thickness of the lateral wall of the firearm fitment sleeve and the barrel diameter has a value within the range for the maximum inner diameter of the firearm accessory adapter and the minimum inner diameter of the firearm accessory adapter.

An object of the invention is to provide a fitment sleeve that enables a firearm accessory adapter to fit most firearms on the market.

An object of the invention is to provide a tool-less and easy-to-use fitment sleeve that can quickly, accurately, securely, and concentrically ensleeve the barrel of a firearm.

It is another object of the invention to provide a fitment sleeve that is far less costly to manufacture than a slew of accessory adapters to fit various barrel diameters.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the present invention, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention includes a device, and method of use thereof, for adjusting the size and shape of a firearm barrel. The present invention was designed in part to overcome a common issue in the firearm industry—firearm accessory adapters being designed specifically for the dimensions of a particular firearm barrel and not being suitable for different barrel designs and sizes. The fitment sleeve of the present invention is adapted to safely, securely, and temporarily alter the size and shape of a firearm barrel such that a wide variety of firearm accessory adapters, such as rail attachments and suppressor attachments can be used on a particular firearm barrel regardless of whether the adapters are designed and intended to fit said firearm barrel. This benefit reduces the costs associated with manufacturing, packaging, labeling, and stocking adapters because a single adapter can replace thousands of different adapter designs when used in connection with the fitment sleeve of the present invention. Ultimately, the fitment sleeve provides an inexpensive and highly variable means for fitting a single size adapter to most firearms without having to modify the firearm barrel, or in other words, the fitment sleeve allows a plurality of adapters to be secured to a particular firearm barrel. The fitment sleeve provides the additional benefit of protecting the barrel of the firearm from the contacting surfaces of the adapter, which can deface the barrel and, thus, devalue the firearm.

Figure 1:
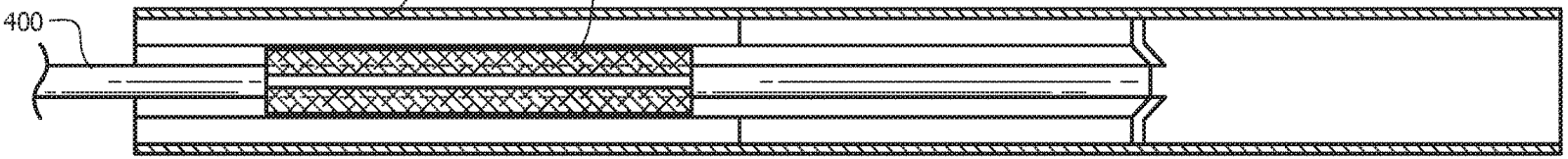
FIG. 1 is a sectional elevation view of an embodiment of the present invention.

Referring now to FIG. 1, an embodiment of fitment sleeve 100 is adapted to ensleeve firearm barrel 400. Adapter 200 can then be attached to barrel 400 in overlying relation to fitment sleeve 100. Fitment sleeve 100 is preferably made of a flexible and compressible material allowing fitment sleeve 100 to conform to barrel 400 while also compressing under the force imposed by adapter 200 when adapter 200 is securely tightened around barrel 400. The fitment sleeve doesn't require any tooling or permanent modification to the barrel for securement of the adapter to a firearm. Moreover, the fitment sleeve will protect the barrel from permanent damage, which is often associated with barrel adapters.

Furthermore, fitment sleeve 100 is heat resistant, preferably at least up to 150 degrees Fahrenheit to compensate for the heating of barrel 400 when in use. Firearm barrels, however, can reach temperatures in excess of 1300 degrees Fahrenheit. Therefore, an embodiment of the fitment sleeve is adapted to withstand heat in excess of 1300 degrees Fahrenheit without melting. There may be several categories of fitment sleeves based on the rate of fire of the firearm. For example, a fully automatic firearm will have the potential to become much hotter than a bolt action rifle, and therefore, the category of fitment sleeves for fully automatic firearms will be more heat resistant than the category of fitment sleeves for single shot firearms.

Figure 2:
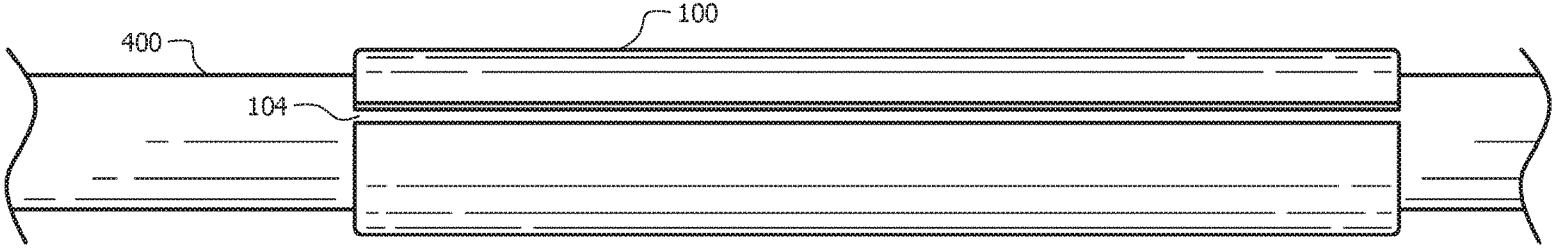
FIG. 2 is a side view depicting an embodiment of the fitment sleeve secured to a barrel.

As shown in FIG. 2, an embodiment of fitment sleeve 100 includes self-adjusting slot 104 extending the length of fitment sleeve 100. Slot 104 allows fitment sleeve 100 to adjust in diameter to receive a wider range of barrel diameters. The size of slot 104, or the distance between the circumferential free ends of fitment sleeve 100, is preferably less than the diameter of fitment sleeve 100 when fitment sleeve 100 is in a position of repose. Alternatively, if one considers fitment sleeve 100 to have an imaginary continuous circumference, slot 104 extends less than half of said circumference.

Moreover, as adapter 200 adds pressure to fitment sleeve 100, slot 104 allows fitment sleeve 100 to adjust to manufacturing differences in barrel diameter of multiple tenths, hundreds, and thousandths of an inch through the narrowing and widening of gap 104 without further effort from the operator. An embodiment of slot 104 is sized such that fitment sleeve 100 can slide onto the end of a barrel with the iron sights on the barrel passing through slot 104.

Figure 3A:
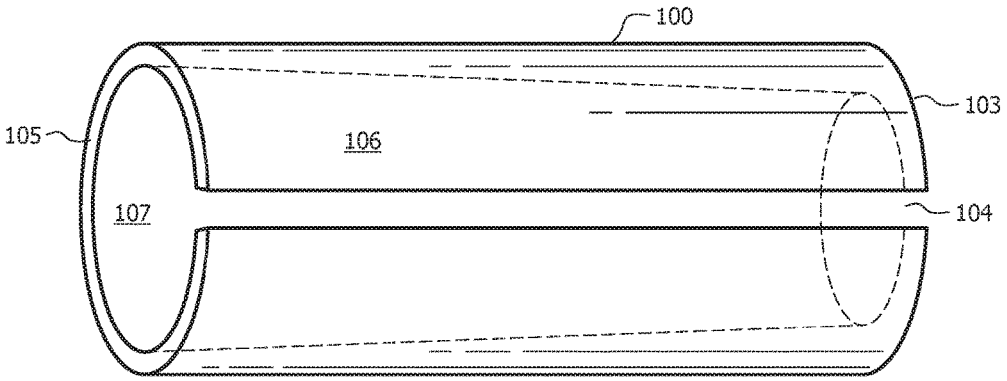
FIG. 3A is a perspective view depicting an embodiment of the fitment sleeve.
Figure 3B:
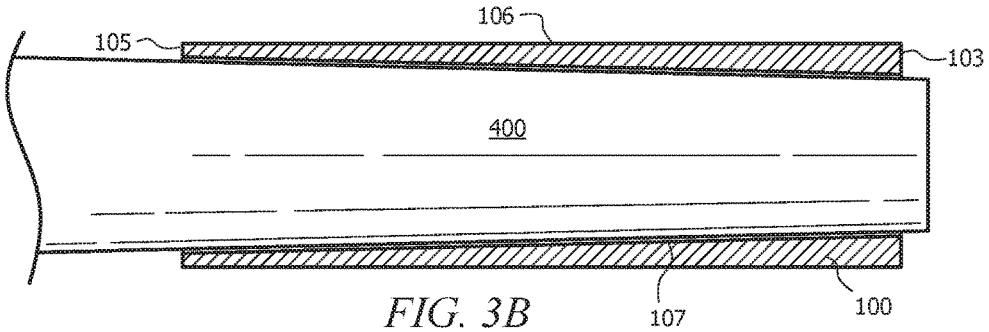
FIG. 3B is a side sectional view depicting an embodiment of the fitment sleeve secured to a barrel.

Referring now to FIG. 3, an embodiment of fitment sleeve 100 includes first end 103 having a greater thickness than the second end 105 to account for tapered barrels. The tapered design is preferably accomplished by altering the diameter of internal surface 107 along the length. As depicted in FIG. 3, the diameter of internal surface 107 reduces from the second end 105 towards the first end 103. As clearly depicted in FIG. 3B, fitment sleeve 100 can effectively convert a section of tapered barrel 400 into a section having a uniform outer diameter on which a cylindrical adapter can be secured. In an embodiment, slot 104 may be wider at one end and narrower at the other end to improve the fitment of adapter 200 to tapered barrel 400.

Figure 4:
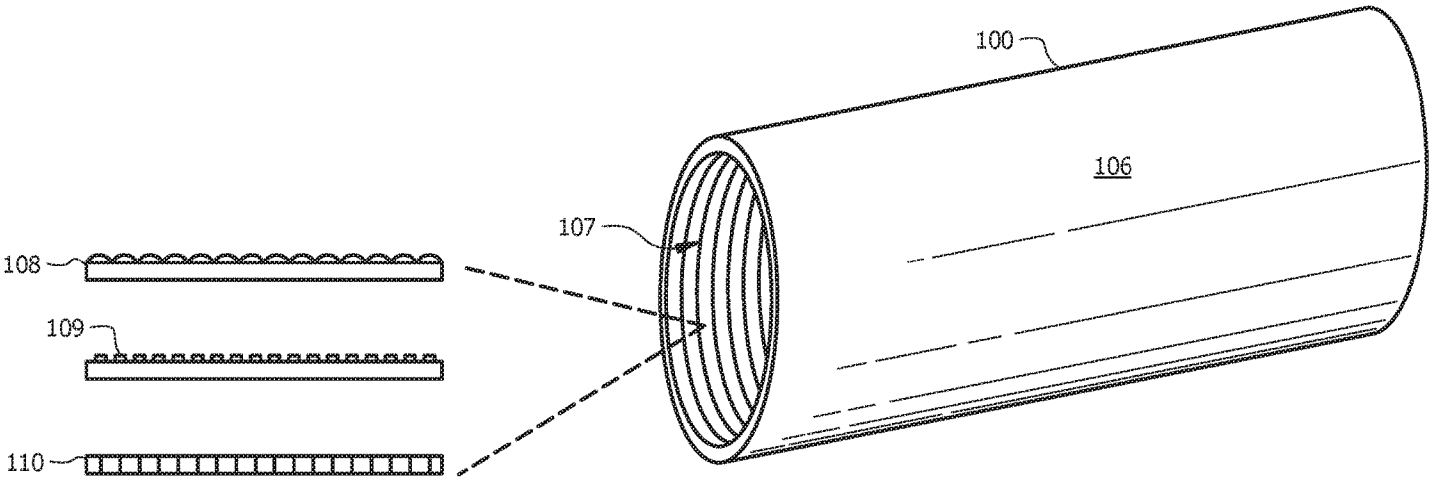
FIG. 4 is a perspective view depicting an embodiment of the fitment sleeve.

As depicted in FIG. 4, an embodiment of fitment sleeve 100 may include friction inducing features on internal surface 107. The friction inducing features include but are not limited to grooves 108, ridges 109, or slits 110, on inner surface 107 of fitment sleeve 100, for a more secure attachment of fitment sleeve 100 on a smooth metallic gun barrel 400. Alternatively, or in addition to, an embodiment of fitment sleeve 100 may include friction inducing features on external surface 106 to better secure adapter 200 to fitment sleeve 100. In an embodiment, fitment sleeve 100 may rely on a sticky film or adhesive on internal surface 107 to increase the friction between fitment sleeve 100 and barrel 400. Moreover, an embodiment of fitment sleeve 100 or simply internal surface 107 may be made of a material known to have a coefficient of friction that will prevent the fitment sleeve from sliding along the barrel of a firearm when the firearm is jostled or fired.

Figure 5A:
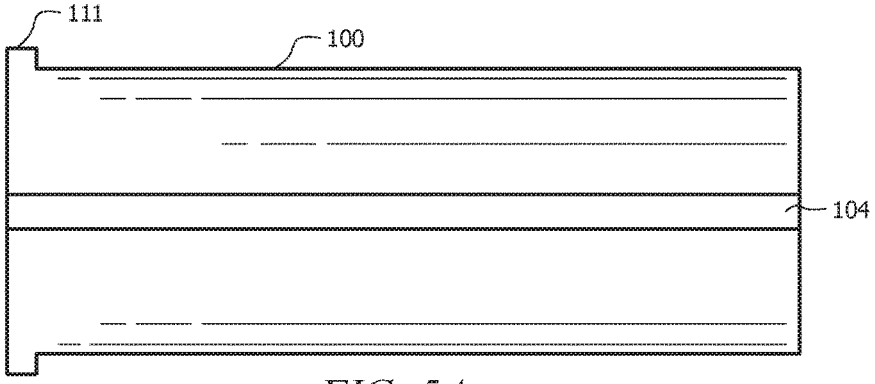
FIG. 5A is a side view depicting an embodiment of the fitment sleeve.
Figure 5B:
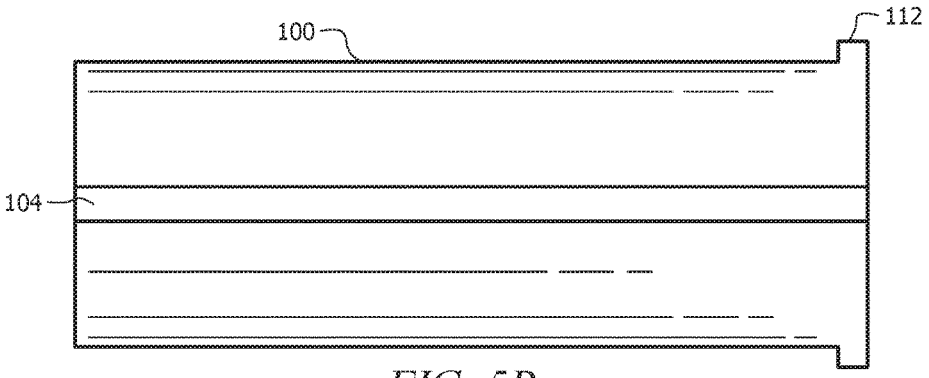
FIG. 5B is a side view depicting an embodiment of the fitment sleeve.

Referring now to FIG. 5, an embodiment may include annular stop 111 at the proximal end of fitment sleeve 100 to help secure the location of fitment sleeve 100 with respect to adapter 200. Alternatively, or in addition to, an embodiment may include annular stop 112 at the distal end of fitment sleeve 100 to help secure the location of fitment sleeve 100 with respect to adapter 200. Slot 104 preferably also extends through annular stops 111, 112.

Figure 6:
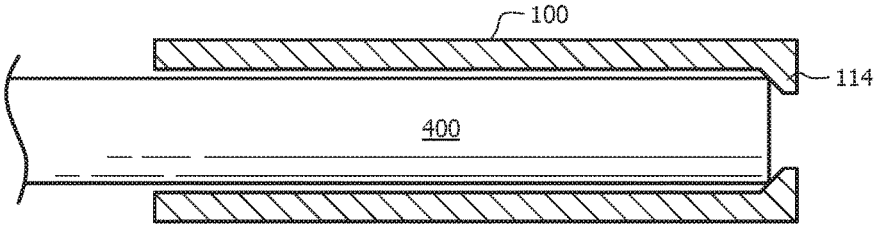
FIG. 6 is a side sectional view depicting an embodiment of the fitment sleeve secured to a barrel.

Referring to FIG. 6, an embodiment of fitment sleeve 100 may include a uniquely shaped annular flange (referred to as a "barrel guide 114") integrated into the distal end of fitment sleeve 100 to help secure the location of fitment sleeve 100 with respect to barrel 400 while also aligning barrel 400 with fitment sleeve 100. Barrel guide 200 may be an inwardly extending annular flange, an inwardly-extending, distally-angled flange as depicted, or an inwardly-extending, concave flange. The flange preferably extends inwardly a limited distance such that the flange does not extend to the bore in barrel 400. This limited extension ensures that the flange will not be contacted by a projectile fired from barrel 400.

Figure 7:
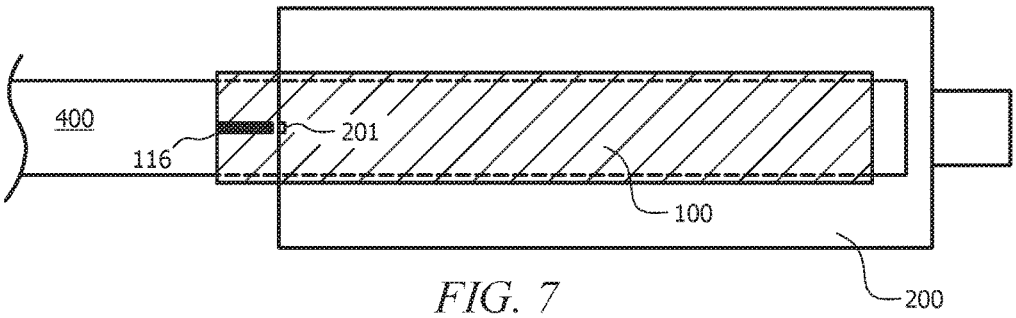
FIG. 7 is a side sectional view depicting an embodiment of the present invention having an alignment indicator.

Referring now to FIG. 7, an embodiment includes alignment indicator 116 disposed on outer surface 106. In an embodiment, alignment indicator 116 is intended to work in conjunction with alignment indicator 201 on adapter 200. As a result, adapter 200 can be precisely fit to a specific gun and the alignment indicators can be aligned or the locations of each can be noted. A user can then remove the adapter and later attach the adapter at the precise location that it was previously attached using the alignment indicators.

An embodiment of fitment sleeve 100 may be a solid, flexible/compressible tubing, a solid non-compressible tubing, shrink wrap, or multi-slot compressible sleeve. An embodiment may also include a plurality of apertures disposed in the fitment sleeve to allow barrel heat to more easily dissipate.

In an embodiment, fitment sleeve 100 is generally transparent to allow the fitment sleeve to remain on the barrel of the firearm without affecting the aesthetics of the firearm. Alternatively, the fitment sleeve may be specifically designed to have the same color as the barrel on which it is intended to reside.

Figure 8:
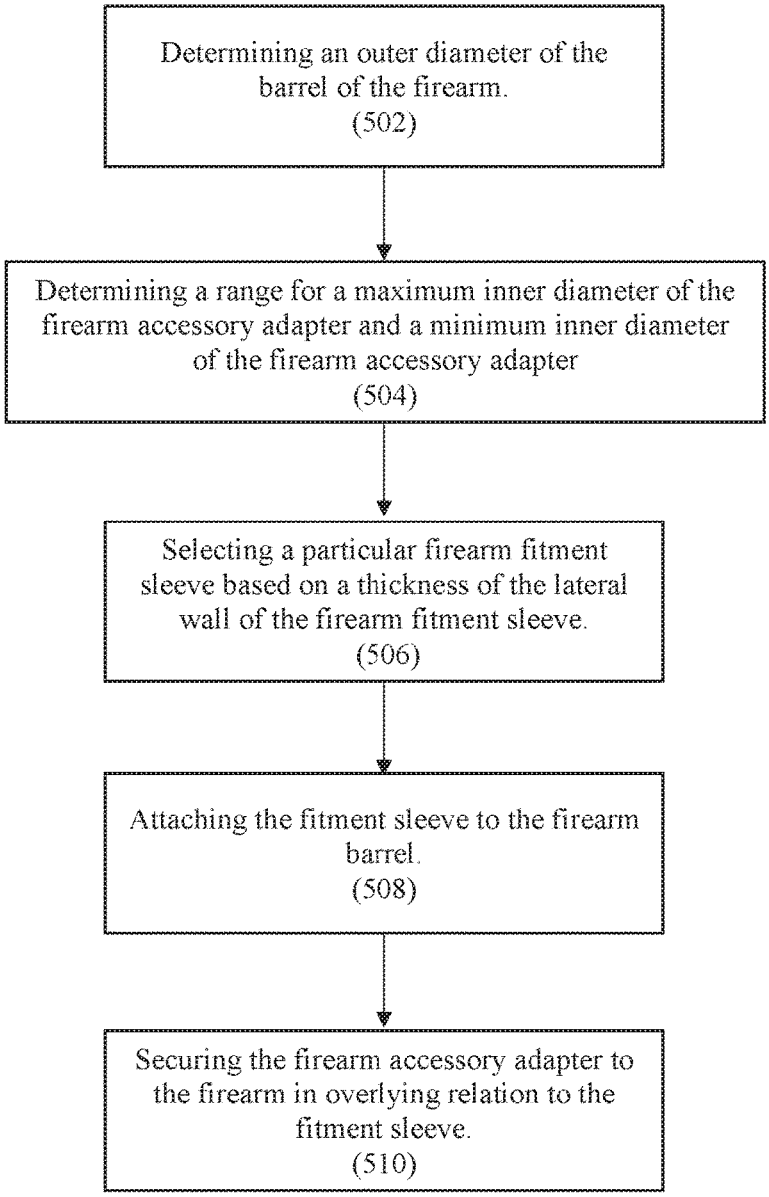
FIG. 8 is a flowchart of an embodiment of the present invention.

As depicted in FIG. 8, the novel method includes determining an outer diameter of the barrel of the firearm 502, determining a range for a maximum inner diameter of the firearm accessory adapter and a minimum inner diameter of the firearm accessory adapter 504, and selecting a particular firearm fitment sleeve based on a thickness of the lateral wall of the firearm fitment sleeve, such that the sum of the thickness of the lateral wall of the firearm fitment sleeve and the barrel diameter has a value within the range for the maximum inner diameter of the firearm accessory adapter and the minimum inner diameter of the firearm accessory adapter 506. Next, the firearm fitment sleeve receives a section of the barrel of the firearm 508 and then the firearm accessory adapter is secured to the firearm in overlying relation to the fitment sleeve 510.

Exemplary Adapters that May be Used with the Novel Fitment Sleeve

Figure 9:
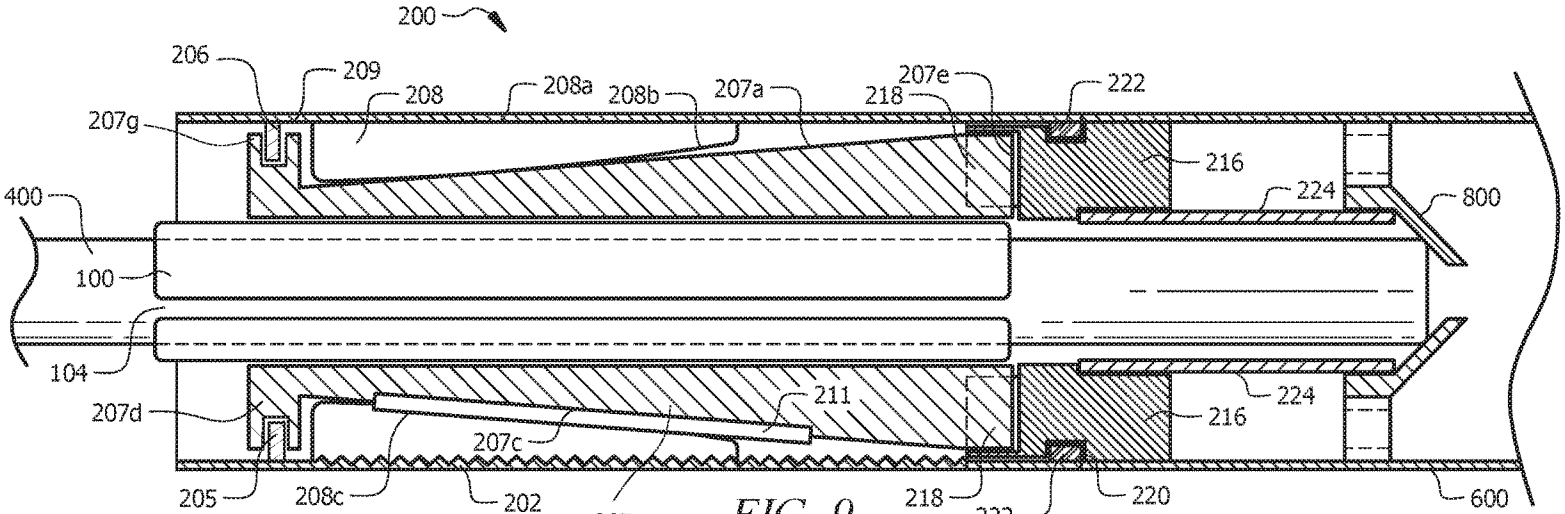
FIG. 9 is a sectional elevation view of an embodiment of an adapter.

As shown in FIG. 9, an embodiment of firearm adapter 200 includes an attachable or integrated suppressor 700 and/or suppressor extension 600. Adapter 200 is configured to ensleeve and easily compress around barrel 400. An embodiment may include fitment sleeve 100 to effectively increase the diameter of barrel 400. As a result, adapter 200 can establish a proper amount of compression force around barrel 400 to ensure that adapter 200 remains fixed to barrel 400 during use of the firearm.

Figure 10:
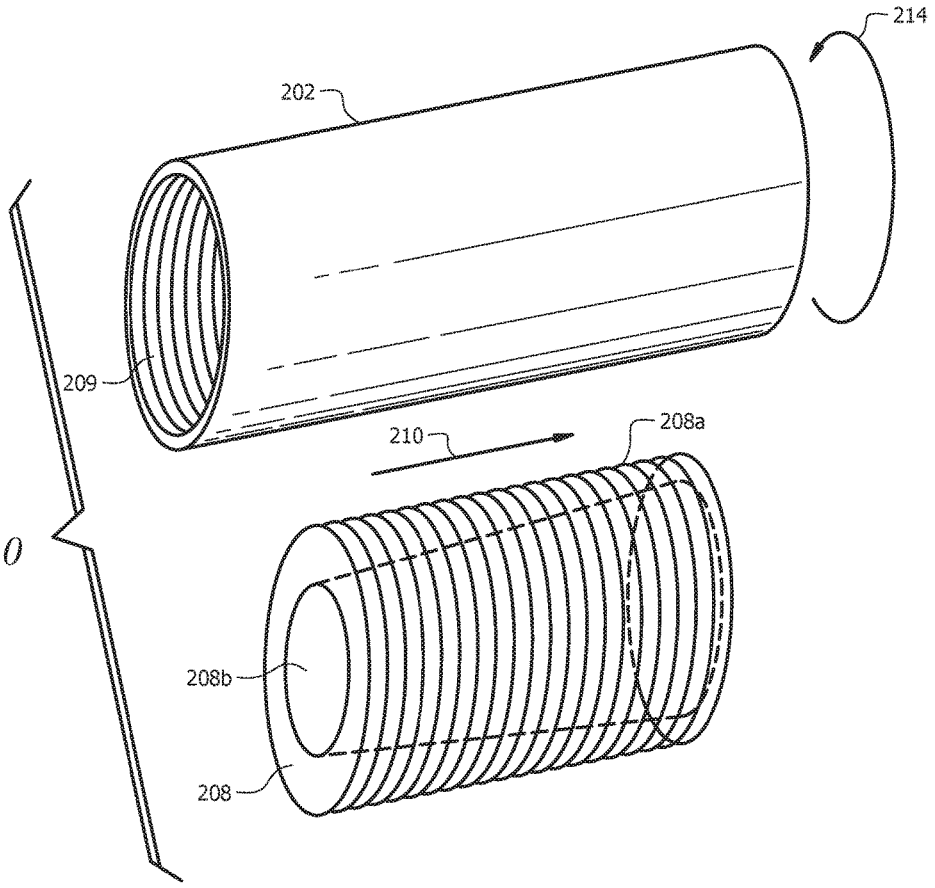
FIG. 10 is an exploded view showing the outer rotatable sheath and the compression collar of the adapter.

Referring now to FIG. 10, an embodiment of adapter 200 includes first sheath 202 housing a generally cylindrical, but tapered compression collar 208 and at least partially housing a generally cylindrical, but tapered constricting sleeve 207. Compression collar 208 is sandwiched between sheath 202 and constricting sleeve 207. Moreover, first sheath 202 is in rotational communication with second sheath 203, an integrated suppressor 700, or an integrated suppressor extension 600. The latter is depicted in FIG. 10.

Figure 11:
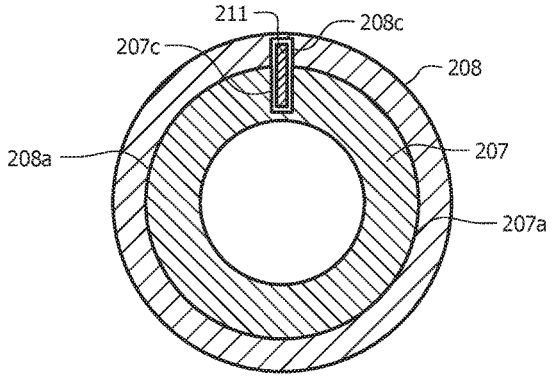
FIG. 11 is a cross-sectional view highlighting the key residing within the key slots of the compression collar and the constricting sleeve.

As depicted in FIGS. 10-11, an embodiment of first sheath 202 includes threaded internal surface 209. Outer surface 208*a* of compression collar 208 is inversely threaded with respect to internal surface 209 and in contact with said surface, such that rotation of first sheath 202, as depicted by arrow 214, causes linear translation of compression collar 208 in a direction parallel to the longitudinal axis of adapter 202, as depicted by arrow 220. It should be noted that while threads are circumferentially present on internal surface 209, the threads are not shown on the top half in FIGS. 10 and 12 to provide an additional level clarity.

As best depicted in FIG. 11, compression collar 208 further includes key slot 208*c* disposed in internal surface 208*b*. Key slot 208*c* is radially aligned with key slot 207*c* in outer surface 207*a* of constricting sleeve 207. In conjunction, key slots 207*c*, 208*c* received key 211. Key 211 prevents rotation of compression collar 208 with respect to constricting sleeve 207. Prevention of rotation of compression sleeve 208 with respect to constricting sleeve 207 helps compression collar 208 to travel in a linear direction when first sheath 202 is rotated.

In an embodiment, compression collar 208 is radially integrated into first sheath 202 and inner surface 208*b* of compression collar 208 is in threaded communication with outer surface 207*a* of constricting sleeve 207. This arrangement will also allow for the liner translation of compression collar 208 when sheath 202 is rotated.

Referring back to FIG. 9-10, inner surface 208*b* of compression collar 208 is tapered such that a second end (proximal end in FIGS. 9-10) has an inner diameter less than the inner diameter at the first end (distal end in FIGS. 9-10). Conversely, outer surface 207*a* of restricting sleeve 207 is tapered such that a first end (proximal end in FIGS. 9-10) has an outer diameter greater than the outer diameter at the second end (distal end in FIGS. 9-10). The direction of the taper of compression collar 208 and direction of the taper of constricting sleeve 207 are inversely oriented with respect to each other, such that tapered inner surface 208*b* of compression collar increases in diameter in a first direction (a distal direction in the embodiment shown in FIG. 9) and 208 tapered outer surface 207*a* of constricting sleeve 207 increases in diameter in the first direction.

The rotation of sheath 202 in a first direction (depicted by arrows 214 in FIG. 12), and the resulting linear travel of compression collar 108 in the first direction (a distal direction in the embodiment shown in FIG. 2, exemplified by arrow 210 in FIG. 12) produces a radial compression force (depicted by arrows 212) as compression collar 108 moves along outer surface 207*a* of constricting sleeve 207 towards distal end 207*e* of constricting sleeve 207. As compression collar 208 moves towards distal end 207*e* of constricting sleeve 207, the combined thickness of compression collar 208 and constricting sleeve 207 increases, and because sheath 202 is rigid, constricting sleeve 207 is forced inwardly towards the longitudinal axis of barrel 400. In other words, internal surface 207*b* of constricting sleeve 107 reduces in diameter compressing around barrel 400, or fitment sleeve 100.

Figure 12:
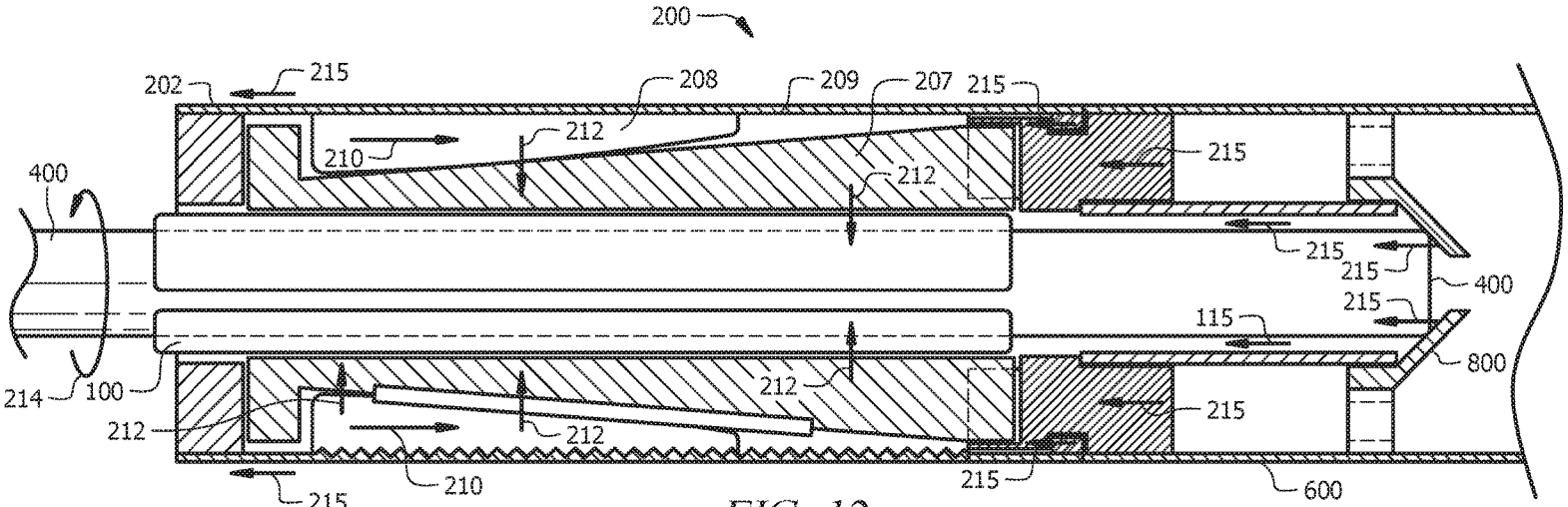
FIG. 12 is a sectional elevation view highlighting the internal mechanisms of the adapter with force arrows.

Correspondingly, rotation of sheath 202 in a second direction, opposite the first, will result in compression collar 208 linearly traveling in a second direction—the proximal direction in the exemplified embodiments in FIGS. 9 and 12. The thicker portions of compression collar 208 and constricting sleeve 207 move away from each other and the compression force on barrel 400 and/or fitment sleeve 100 reduces in magnitude.

Constricting sleeve 207 is adapted to yield under compression force such that inner surface 207*b* reduces in diameter. Moreover, constricting sleeve 207 is adapted the return to its original shape upon the removal of compression force. Thus, constricting sleeve 207 is preferably made of a flexible yet resilient material.

Figure 13:
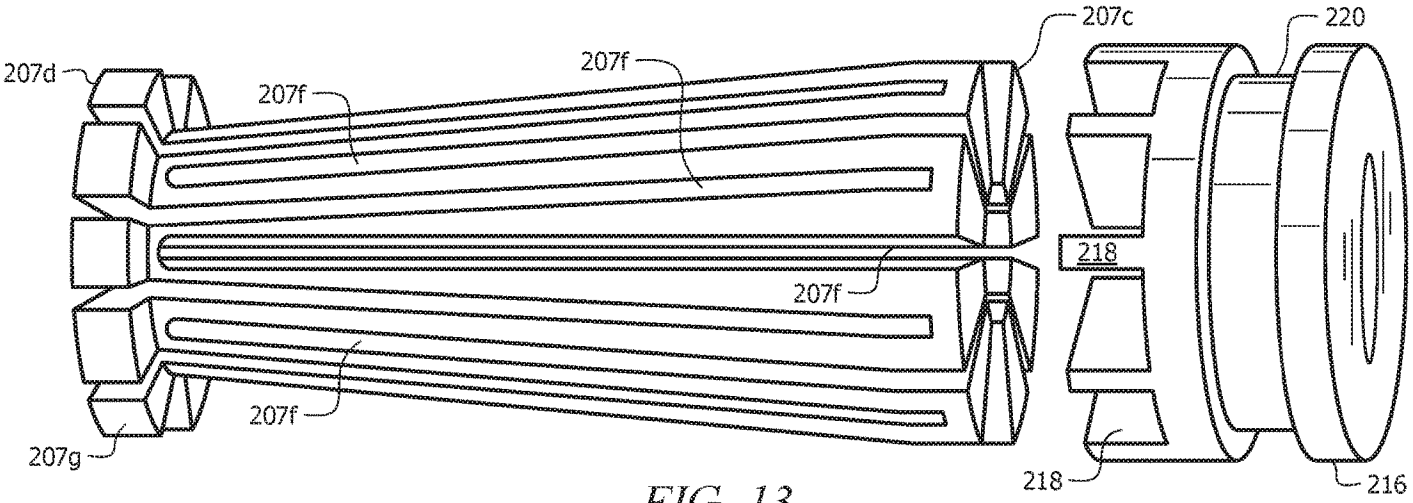
FIG. 13 is an exploded view highlighting the constricting sleeve and the force transferring collar.

In an embodiment, as depicted in FIG. 13, constricting sleeve 207 has a discontinuous perimeter at both the proximal and distal ends 207*d*, 207*e*. The discontinuous nature is achieved through expansion/contraction adjustment slots 207*f*. Adjustment slots 207*f* preferably extend along the majority of the length of constricting sleeve 207 thereby providing the necessary circumferential gaps to reduce the diameter of constricting sleeve 207.

In an embodiment, proximal end 207*d* includes an outwardly extending annular flange 207*g*. Annular flange 207*g* works in conjunction with an inwardly projecting annular rim 206 near the proximal end of adapter 200 to prevent constricting sleeve 207 from exiting the proximal end of sheath 202. Annular rim 206 also has a central bore for receiving barrel 400 and fitment sleeve 100. As depicted in FIG. 9, Annular rim 206 is radially aligned with a portion of annular flange 207*g* and is adapted to insert into an annular groove in annular flange 207*g* to also help prevent constricting sleeve 207 from binding with force transfer collar 216. Alternatively, as depicted in FIG. 12, annular rim 206 is longitudinally spaced from constricting sleeve 206 providing a simple backstop to prevent constricting sleeve 207 from exiting the proximal end of sheath 202.

Figure 14:
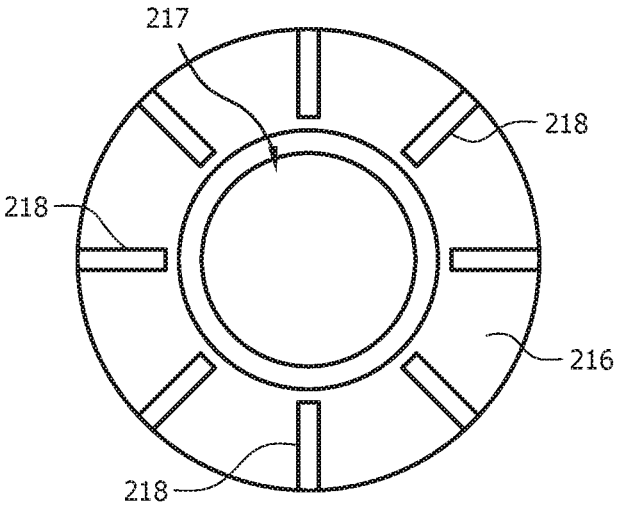
FIG. 14 is an end view of the force transferring collar.
Figure 15A:
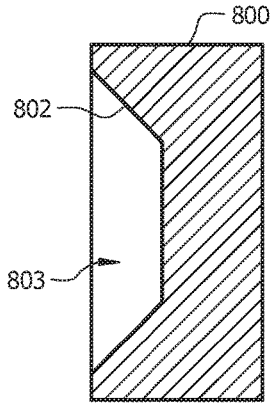
FIG. 15A is a side sectional view of an embodiment of the barrel guide.
Figure 15B:
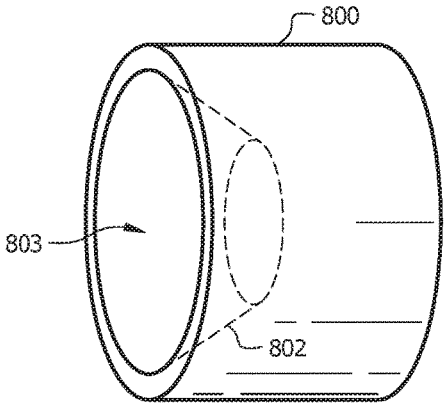
FIG. 15B is a perspective view of an embodiment of the barrel guide.
Figure 15C:
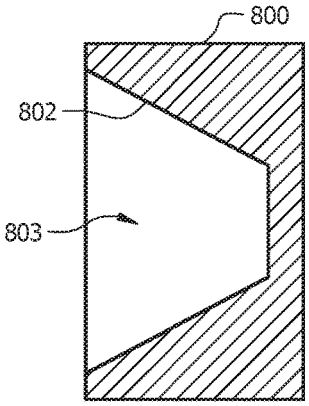
FIG. 15C is a side sectional view of an embodiment of the barrel guide.
Figure 15D:
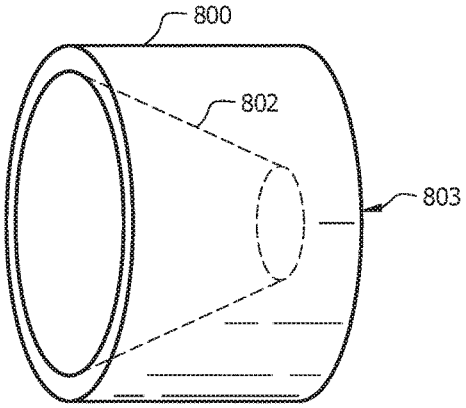
FIG. 15D is a perspective view of an embodiment of the barrel guide.

In the exemplary embodiment in FIGS. 9 and 13, adjustment slots 207*f* serve an additional purpose. At distal end 207*e*, adjustment slots 207*f* receive flanges 218 extending from force transfer collar 216 in an axial direction, which is best depicted in FIGS. 13-14. Flanges 218, however, are preferably sized to avoid having a significant effect on the constricting sleeve's ability to radially compress.

Force transfer collar 216 is fixed to second sheath 203, an integrated suppressor 700, or an integrated suppressor extension 600 (the latter is depicted in FIG. 9). As a result, force transfer collar 216 is rotationally fixed with respect to second sheath 203, an integrated suppressor 700, or an integrated suppressor extension 600. The interconnection of flanges 118 and adjustment slots 207*f* in turn prevent rotation of constricting sleeve 207 with respect to second sheath 203, an integrated suppressor 700, or an integrated suppressor extension 600; and key 211 prevents rotation of compression collar 208 with respect to constricting sleeve 207. Therefore, force transfer collar effectively prevents rotation of compression collar 208 when sheath 202 is rotated, which enables compression collar 208 to travel in a linear direction when sheath 202 is rotated.

As depicted in FIG. 14, force transferring collar 216 includes a central bore 217 sized to receive barrel 400. Preferably, force transferring collar 216 has an inner diameter equal to the inner diameter of constricting sleeve 207 when constricting sleeve 207 is free of any compression forces, i.e. in a position of repose.

Referring back to FIG. 9, an embodiment of force transferring collar 216 includes an annular notch 220 between flanges 218 and the distal end of force transferring collar 216. Annular notch 220, preferably freely, receives retention ring 122 secured to sheath 202. Retention ring 222 in combination with annular notch 220 keeps sheath 202 rotationally secured to second sheath 203, an integrated suppressor 700, or an integrated suppressor extension 600. Retention ring 122 may include or be comprised of bearings to reduce the friction during rotation of sheath 202.

An embodiment of adapter 200 may also include barrel guide 800. As illustrated in FIG. 9, barrel guide 800 may be in mechanical communication with force transferring collar 216 through structural member 224 and/or may be secured directly to second sheath 203, an integrated suppressor 800, or an integrated suppressor extension 600.

Barrel guide 800 allows a user to quickly and efficiently install and align adapter 200 to gun barrel 400. Barrel guide 800 is adapted to guide the muzzle into alignment with second sheath 203, an integrated suppressor 700, or an integrated suppressor extension 600 using, for example, distally and inwardly angled walls 802. Walls 802 extend inwardly enough to catch the muzzle of barrel 400 without extending far enough towards the longitudinal axis to impede a bullet exiting barrel 400.

Figure 16A:
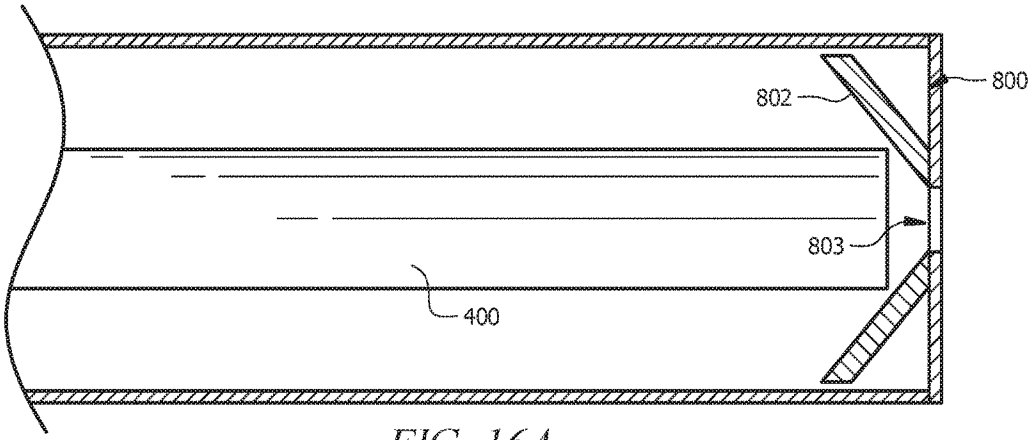
FIG. 16A is a side sectional view of an embodiment of the barrel guide secured within a second sheath.
Figure 16B:
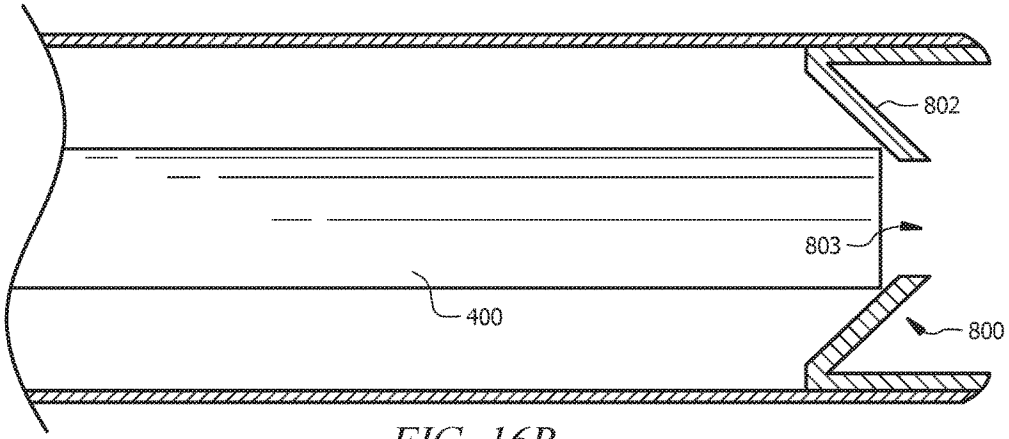
FIG. 16B is a side sectional view of an embodiment of the barrel guide secured within a second sheath.

As depicted in FIGS. 15-16, barrel guide 800 preferably has a frustoconical-shaped bore 803 to guide barrel 400, but may have any curved or angled walls shaped to funnel barrel 400 towards central bore 803 when subject to an axial force causing barrel 400 to contact barrel guide 800. Barrel guide 800 can be as simple as a hollow cone shaped device built with various angles preferably between 10 and 80 degrees. Barrel guide 800, used in conjunction with the concentric tightening of constricting sleeve 207 results in an adapter perfectly aligned to the barrel of the firearm. No tools or extra effort are required.

Barrel guide 800 provides extreme flexibility in that it will align any size barrel that falls between the outside diameter of conical bore 803 and the inside diameter of conical bore 803. In an embodiment, barrel guide 800 may threadedly engage and disengage or may be secured directly to structural member 224 and/or to second sheath 203, an integrated suppressor 700, or an integrated suppressor extension 600. This temporary attachment allows barrel guide 800 to be modified as need to provide a properly sized barrel guide 800 based on the barrel diameter. A single cone, however, will fall easily within the common minimum barrel size of 0.55 and the common maximum barrel size of 1.05.

Figure 17A:
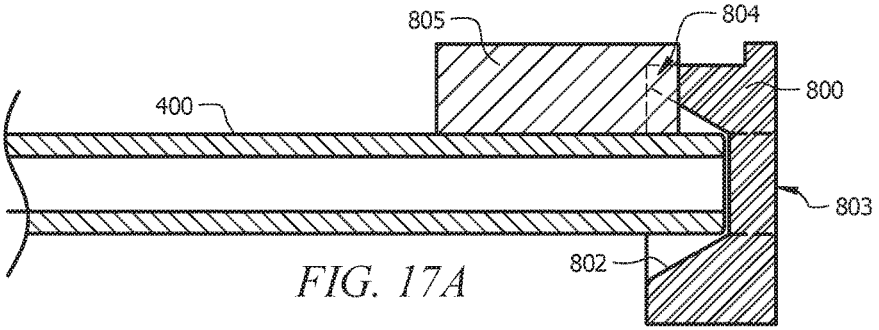
FIG. 17A is a side sectional view of an embodiment of the barrel guide with a cutout for iron sights.
Figure 17B:
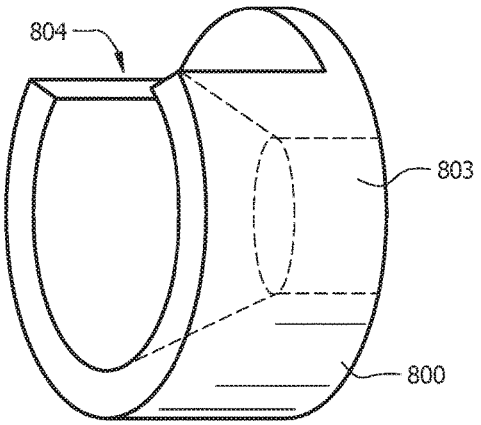
FIG. 17B is a perspective view of an embodiment of the barrel guide with a cutout for iron sights.
Figure 17C:
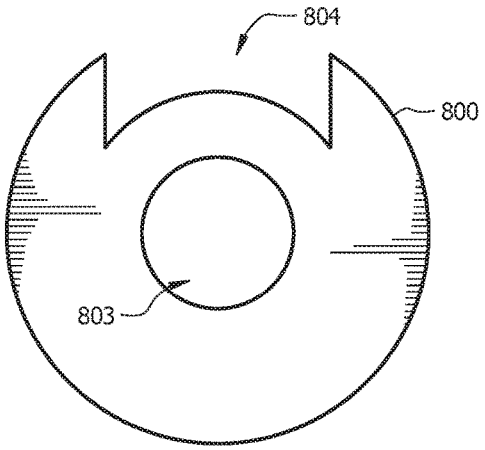
FIG. 17C is an end view of an embodiment of the barrel guide with a cutout for iron sights.

Referring now to FIG. 17, an embodiment of barrel guide 800 includes cutout 804 for iron sights 805 in the proximal end of barrel guide 800. Such an embodiment preferably includes a vertical alignment indicator to inform a user of the location of the cutout 804 within second sheath 203, an integrated suppressor 700, or an integrated suppressor extension 600.

Barrel guide 800 comprises of a heat resistant, preferably flexible material for flexibly shaping to the muzzle. The flexibility helps form a tight seal with the muzzle. Alternatively, an embodiment may include a mechanical biasing member around the conical bore. As the cone is pushed against the muzzle, the spring compresses to form a tight seal and to facilitate perfect alignment. The spring can be placed in various positions and placements around the barrel guide to achieve compression. This seal is particularly important to prevent gas from escaping the suppressor and/or extension in a proximal direction and exiting the proximal end of outer sheath 202.

Barrel guide 800 can stand alone within adapter 200 or be integrated with the fitment sleeve, constricting sleeve, second sheath 203, an integrated suppressor 700, or an integrated suppressor extension 600.

Referring back to FIG. 12, barrel guide 800 also provides the necessary frontal stop to fix adapter 200 in place when adapter 200 is tightened around barrel 400. As sheath 202 is rotated in direction 214, compression collar 208 is forced towards distal end 207*e* of constricting collar 207 in accordance with directional arrow 210. The combined thickness of compression collar 208 and constricting sleeve 207 is met by internal surface 109 of sheath 202 and constricting sleeve 207 compresses in an inwardly direction depicted by directional arrows 212. After a certain amount of rotation of sheath 202, internal surface 207*b* of constricting sleeve 207 will compress into barrel 400, or fitment sleeve 100. Once constricting sleeve 207 and compression collar 208 can no longer move radially due to the compression force, further rotation of outer sheath 202 in accordance with rotational arrow 214 will cause outer sheath 202 to translate in the proximal direction, opposite of the direction of travel of compression collar 208, as depicted by arrows 215. Retention ring 222 will in turn pull force transfer collar 216 according to directional arrows 215. Because force transfer collar 216 is in mechanical communication with barrel guide 800, either through structural member 124, second sheath 203, integrated suppressor 700, and/or integrated suppressor extension 600 (the latter is depicted in FIG. 12), barrel guide 800 will also be pulled in the proximal direction as depicted by arrows 215 until barrel 400 contacts barrel guide 800 to securely aligned barrel 400 with adapter 200. In other words, adapter 200 is a self-aligning adapter.

Figures 18A, 18B:
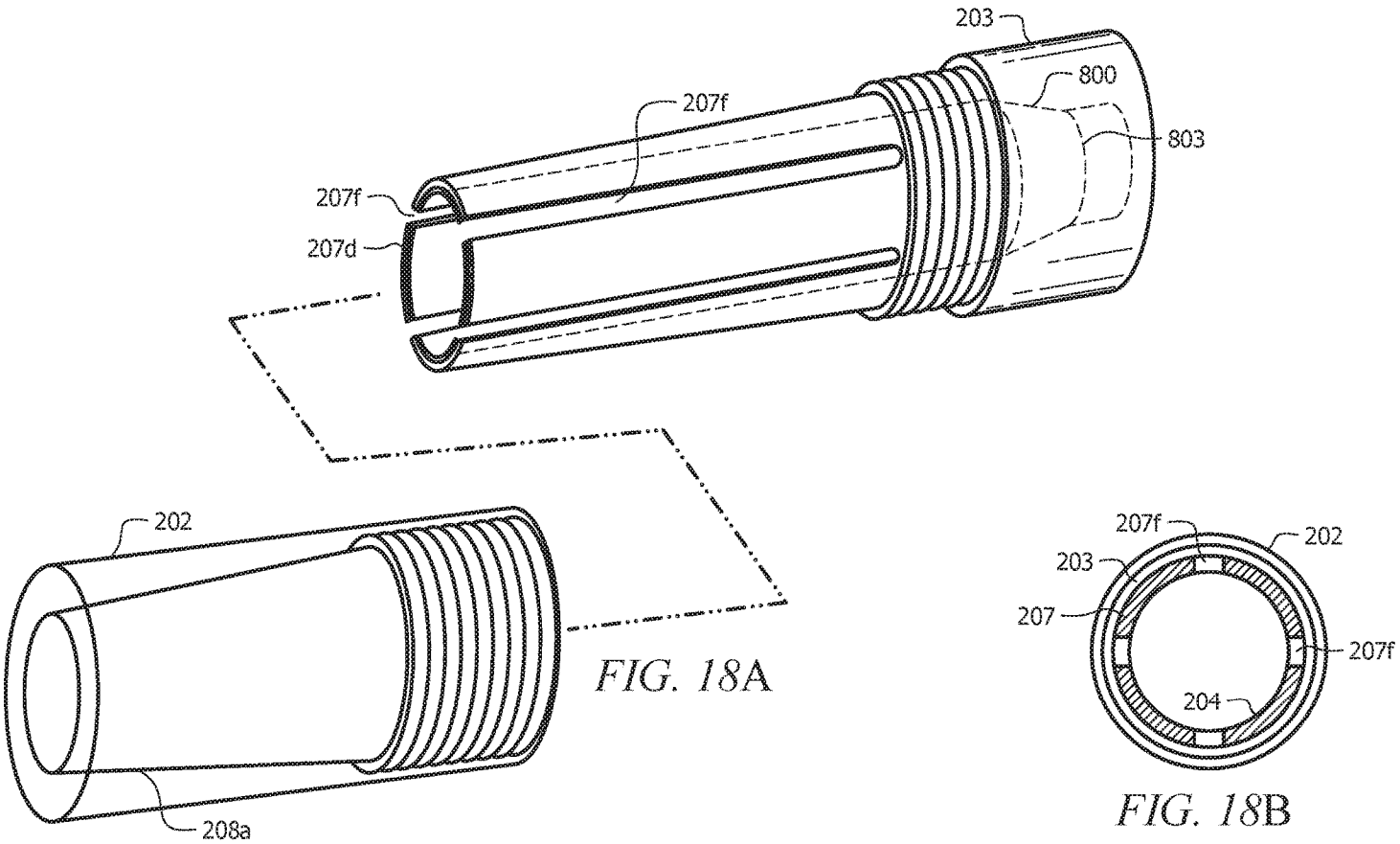
FIG. 18A is a partial exploded view of an embodiment of the adapter highlighting the connection between the first and second sheaths.
FIG. 18B is an end view of the assembled adapter in FIG. 18A.

As depicted in FIG. 18, embodiments may integrate several parts to reduce the costs associated with manufacturing and assembly. An embodiment may include compression collar 208 radially integrated into or secured to sheath 202, such that the outer surface of compression collar 108*a* is the outer surface of sheath 202. A distal end of sheath 202 is in threaded communication with second sheath 203, an integrated suppressor 700, or an integrated suppressor extension 600 (the second sheath is depicted in FIG. 18).

Constricting sleeve 207 may be integrated into sheath 203 through the attachment or integration of distal end 207*e* to sheath 203. Proximal end 207*d* has a discontinuous perimeter achieved through expansion/contraction adjustment slots 207*f*. Adjustment slots 207*f* establish a plurality of free ends, which can flex under compression force to constrict around barrel 400. Adjustment slots 207*f* preferably extend along the length of constricting sleeve 207 thereby providing the necessary circumferential gaps to reduce the diameter of constricting sleeve 207. In addition, inner surface 207*b* is preferably curved to provide a more linear inner surface when compressed towards the longitudinal axis.

Barrel guide 800 is also integrated into sheath 203 by simply tapering the inner surface towards aperture 803. The embodiment further includes threaded suppressor attachment 702 on which a suppressor can be attached. Alternatively, suppressor 700, or suppressor extension 600 can be integrated with the distal end of sheath 203.

Figure 18C:
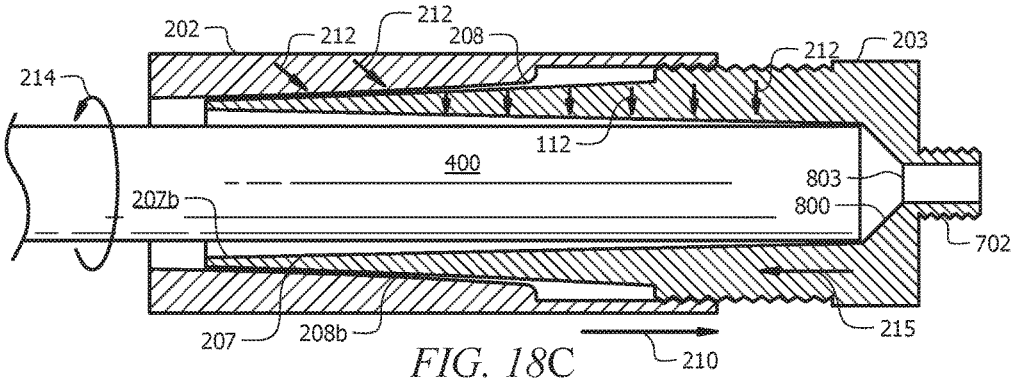
FIG. 18C is a sectional elevation view of an embodiment of the adapter highlighting the internal mechanisms of the adapter with force arrows.

Referring now specifically to FIG. 18C, as sheath 202 is rotated in direction 214, the threaded engagement with sheath 103 causes sheath 202 and its integrated compression collar 208 to translate in a linear direction towards the distal end of sheath 203, as depicted by arrow 210. The tapered inner surface 208*b* of compression collar 208 applies a compression force, depicted by arrows 212, which is applied to constricting sleeve 207 and ultimately barrel 400. After a certain amount of rotation of sheath 202, internal surface 207*b* of constricting sleeve 207 will compress into barrel 400, or fitment sleeve 100 if used. Once constricting sleeve 207 and compression collar 208 can no longer move due to the compression force, further rotation of outer sheath 202 in accordance with rotational arrow 214 will force outer sheath 203 to translate in the proximal direction, opposite of the direction of travel of compression collar 208, as depicted by arrow 215. Because outer sheath 203 is in mechanical communication with barrel guide 800, barrel guide 800 will also be pulled in the proximal direction as depicted by arrows 215 until barrel 400 contacts barrel guide 800 to securely aligned barrel 400 with adapter 200. In other words, the adapter is a self-aligning adapter.

Figure 18D:
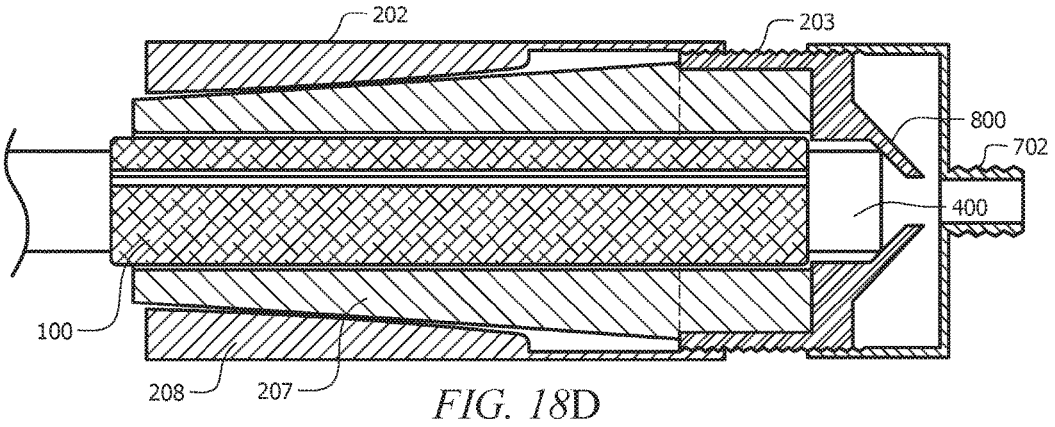
FIG. 18D is a sectional elevation view of an embodiment of the adapter.

Referring now to FIG. 18D, suppressor attachment 702 may be removably attachable to sheath 203, using e.g. the threads on the outer surface of sheath 203. As a result, threaded attachment 702 may be interchangeable with the adapter to account for suppressors with different size threading. This embodiment would be useable with any type of suppressor that relies on a threaded attachment.

Glossary of Claim Terms

Compressible Body: is a body that can change size and/or shape when subjected to a force.

Heat-resistant: means being able to resist and remain generally unaffected by heat.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A firearm barrel fitment sleeve, comprising:

a first end and a second end, with a tubular body extending therebetween;

the tubular body having a barrel-receiving bore extending a full length of the tubular body;

a lateral wall establishing the tubular shape of the tubular body, the lateral wall having an internal surface and an external surface;

a slot passing completely through the lateral wall, such that the tubular body has an incomplete circular cross-section at a point along the length of the tubular body;

the internal surface being heat-resistant to temperatures in excess of 150 degrees Fahrenheit and having a tapered design such that a thickness of the lateral wall of the fitment sleeve is greater proximate a first end than a second end;

an adapter circumferentially encompassing the tubular body of the fitment sleeve when secured thereto; and a suppressor mounted to the adapter in a longitudinally aligned relation with respect to a longitudinal axis of a firearm barrel.

2. The firearm barrel fitment sleeve of claim 1, further comprising a flexible material, thereby allowing the fitment sleeve to flex around a firearm barrel having a diameter greater than a diameter of the internal surface of the fitment sleeve when the fitment sleeve is in a position of repose.

3. The firearm barrel fitment sleeve of claim 1, further comprising a compressible material, thereby allowing an adapter secured around the fitment sleeve to compress the fitment sleeve towards a barrel of a firearm.

4. The firearm barrel fitment sleeve of claim 1, further including an outwardly-extending annular flange proximate the first end of the fitment sleeve and the slot extending through the annular flange such that the annular flange has a discontinuous circumference.

5. The firearm barrel fitment sleeve of claim 1, further including an annular flange proximate the second end of the fitment sleeve and the slot extending through the annular flange such that the annular flange has a discontinuous circumference.

6. The firearm barrel fitment sleeve of claim 1, further including:

an inwardly-extending, sloped annular flange proximate the first end of the fitment sleeve;

the slot extending through the annular flange such that the annular flange has a discontinuous circumference; and whereby an axial force causing the barrel of the firearm to contact the sloped annular flange will funnel a firearm barrel into axial alignment with the barrel-receiving bore.

7. The firearm barrel fitment sleeve of claim 1, further including a plurality of friction-enhancing structural members disposed on the internal surface of the fitment sleeve.

8. A method of attaching a firearm accessory adapter to a barrel of a firearm, comprising:

securing a firearm fitment sleeve around a section of the barrel of the firearm, the fitment sleeve including:

a first end and a second end, with a length extending therebetween;

a barrel-receiving bore extending the length of the fitment sleeve, the bore establishing a lateral wall having an internal surface and an external surface;

the internal surface being heat-resistant to temperatures in excess of 150 degrees Fahrenheit;

an inwardly-extending, sloped annular flange proximate the first end of the fitment sleeve;

the slot extending through the annular flange such that the annular flange has a discontinuous circumference;

whereby an axial force causing the barrel of the firearm to contact the sloped annular flange will funnel a firearm barrel into axial alignment with the barrel-receiving bore;

securing the firearm accessory adapter to the firearm in overlying and ensleeving relation to the fitment sleeve; and securing a suppressor to the firearm accessory adapter such that the bore in the suppressor is longitudinally aligned with the bore or barrel of the firearm.

9. The method of claim 8, further comprising a step of determining an outer diameter of the barrel of the firearm.

10. The method of claim 9, further comprising a step of determining a range for a maximum inner diameter of the firearm accessory adapter and a minimum inner diameter of the firearm accessory adapter.

11. The method of claim 10, further comprising a step of selecting a particular firearm fitment sleeve based on a thickness of the lateral wall of the firearm fitment sleeve, such that the sum of the thickness of the lateral wall of the firearm fitment sleeve and the barrel diameter has a value within the range for the maximum inner diameter of the firearm accessory adapter and the minimum inner diameter of the firearm accessory adapter.

12. The method of claim 8, further comprising the firearm fitment sleeve being comprised of a flexible material, thereby allowing the fitment sleeve to flex around a firearm barrel having a diameter greater than a diameter of the internal surface of the fitment sleeve when the fitment sleeve is in a position of repose.

13. The method of claim 8, further comprising a compressible material, thereby allowing an adapter secured around the fitment sleeve to compress the fitment sleeve towards a barrel of a firearm.

14. The method of claim 8, further including the internal surface having a tapered design such that a thickness of the fitment sleeve is greater proximate a first end than a second end.

15. The method of claim 8, further including the fitment sleeve being removable from the barrel without the need of tools.

16. A method of attaching a suppressor to a firearm, comprising:

securing a firearm fitment sleeve around a section of the barrel of the firearm, the fitment sleeve including:

a first end and a second end, with a length extending therebetween;

a barrel-receiving bore extending the length of the fitment sleeve, the bore establishing a lateral wall having an internal surface and an external surface;

the internal surface being heat-resistant to temperatures in excess of 150 degrees Fahrenheit;

a slot in the lateral wall, the slot extending the full length of the fitment sleeve such that the fitment sleeve has an incomplete circular cross-section;

an outwardly-extending annular flange proximate the first end of the fitment sleeve and the slot extending through the annular flange such that the annular flange has a discontinous circumference; and securing the firearm accessory adapter to the firearm in overlying and ensleeving relation to the fitment sleeve, the firearm accessory adapter having an integrated suppressor, such that a longitudinal axis of a bore in the suppressor is aligned with the longitudinal axis of the barrel of the firearm.

* * * * *